United States Patent [19]

Replogle

[11] 4,192,527

[45] Mar. 11, 1980

[54] PIVOT CLIP FOR A SKI BINDING

[75] Inventor: Douglas L. Replogle, Amherst, N.Y.

[73] Assignee: Moog Inc., East Aurora, N.Y.

[21] Appl. No.: 937,168

[22] Filed: Aug. 28, 1978

[51] Int. Cl.[2] ..... A63C 9/08

[52] U.S. Cl. ..... 280/618; 280/625

[58] Field of Search ..... 280/611, 617, 618, 623, 280/625, 626, 613

[56] References Cited

U.S. PATENT DOCUMENTS

| | | | |
|---|---|---|---|
| 3,785,668 | 1/1974 | Marker | 280/613 |
| 3,838,866 | 10/1974 | D'Alessio et al. | 280/613 X |
| 3,921,995 | 11/1975 | Moog et al. | 280/618 |
| 3,937,480 | 2/1976 | Korger | 280/618 |

*Primary Examiner*—Joseph F. Peters, Jr.
*Assistant Examiner*—Michael Mar
*Attorney, Agent, or Firm*—Sommer & Sommer

[57] ABSTRACT

An improved ski binding has a resiliently-loaded holding device operatively interposed between a boot assembly and a ski to provide points of contact between the boot assembly and ski at each of three mutually-spaced locations arranged at the apices of an imaginary triangle. At each location, a convex member is mounted on the boot assembly to engage a concave surface on the ski. An improved pivot clip is mounted on the ski and provides two of the concave surfaces. The pivot clip has two cam surfaces, each of which is engaged by a convex member mounted on the sole-plate. Each of the cam surfaces is inclined in a direction such that an external moment applied to the boot assembly about the skier's tibial axis will produce a reaction force between one cam surface and its associated convex member, which reaction force will have a longitudinal component not opposing the applied moment.

3 Claims, 7 Drawing Figures

PIVOT CLIP FOR A SKI BINDING

BACKGROUND OF THE INVENTION

1. Field of the Invention

The present invention relates generally to the field of ski bindings, and more particularly to an improved ski binding which permits the use of stiffer plunger springs to increase the binding's lateral shock capability without a concomitant increase in the release torque.

2. Description of the Prior Art

The present invention provides an improvement adapted for use in association with the ski binding disclosed in U.S. Pat. No. 3,921,995, the aggregate disclosure of which is hereby incorporated by reference.

Briefly, said U.S. Pat. No. 3,921,995 discloses a ski binding wherein the sole-plate of a boot assembly is engaged at three locations and is held in a suspended position above the upper surface of the ski. The binding is resiliently-loaded by means of a spring biased plunger acting between the ski and the sole-plate. The sole-plate is designed to separate from the ski, during a fall of the skier, in any direction away from the upper surface of the ski.

Additional details of similar known ski bindings may be shown in U.S. Pat. No. 3,838,866 and German Offenlegungsschrift No. 2 163 892.

SUMMARY OF THE INVENTION

The present invention provides an improvement in a ski binding having resiliently-loaded holding means operatively interposed between a boot assembly and a ski for releasably holding the boot assembly to the ski and for permitting the boot assembly to separate from the ski in any direction away from the ski. The holding means includes, at each of three mutually-spaced locations arranged at the apices of an imaginary triangle, a concave surface on one of the boot assembly and ski and a convex surface on the other of the boot assembly and ski and contacting the concave surface.

The improvement includes a first cam surface mounted on one of the boot assembly and ski and providing a first of said concave surfaces at a first of the three locations arranged on one side of the longitudinal axis of the ski; and a second cam member mounted on one of the boot assembly and ski and providing a second of said concave surfaces at a second of the locations spaced transversely from the first location and arranged on the other side of the longitudinal axis. Each of the first and second cam surfaces is inclined in a direction such that an external moment applied to the boot assembly about the skier's tibial axis will produce a reaction force between one of the cam surfaces and its associated convex member, and the longitudinal component of this reaction force will not oppose the applied moment.

Accordingly, one general object of the present invention is to provide an improved ski binding.

Another object is to provide an improved ski binding in which stiffer plunger springs may be used to increase the binding's lateral shock adsorption capability, without a concomitant increase in release torque.

These and other objects and advantages will become apparent from the foregoing and ongoing written specification, the drawings, and the appended claims.

DESCRIPTION OF THE PREFERRED EMBODIMENTS

Figure 1:
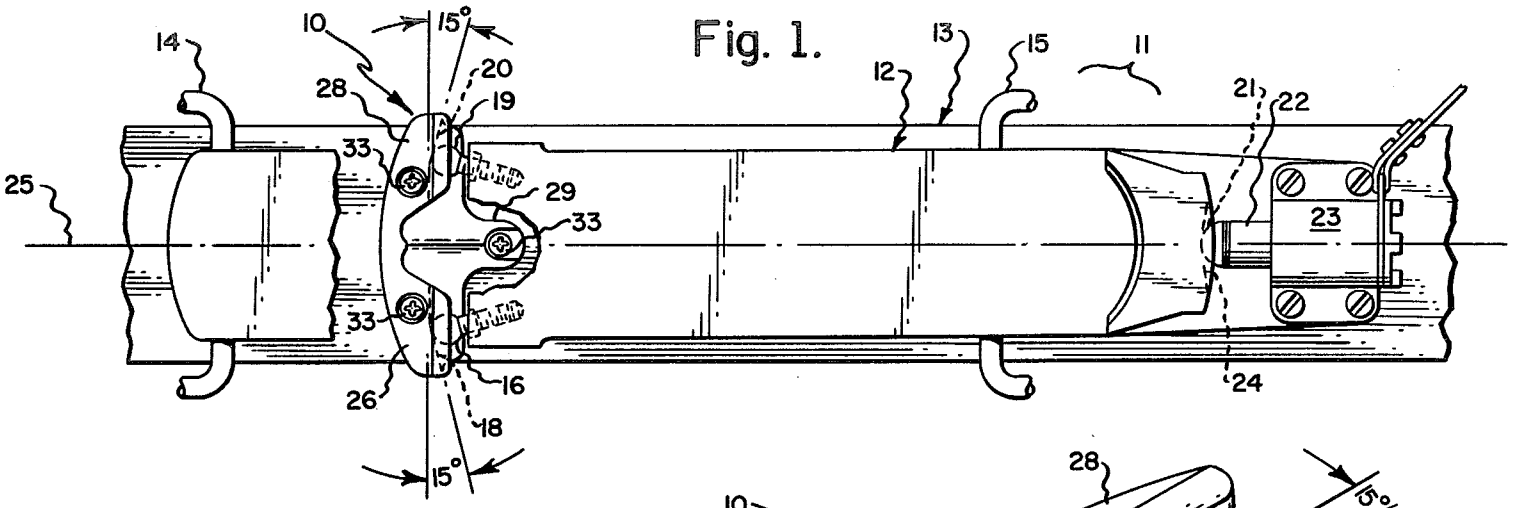
FIG. 1 is a top plan view of an improved ski binding mounted on a fragmentary portion of a ski, this view showing portions of the sole-plate broken away to illustrate the improved pivot clip in top plan.

At the outset, it should be clearly understood that like reference numerals are intended to identify the same elements or structure consistently throughout the several drawing figures, as such elements or structure may be further described or explained by the entire written specification of which this detailed description is an integral part.

Referring now to the drawings, and more particularly to FIG. 1 thereof, this invention provides an improvement for use in association with a ski binding, preferably of the type taught by U.S. Pat. No. 3,921,995, the aggregate disclosure of which is hereby incorporated by reference.

The presently preferred species of the improvement comprises a torque-cancelling pivot clip, generally indicated at 10, which may be substituted for the corresponding pivot clip taught by the aforesaid U.S. Pat. No. 3,921,995.

Inasmuch as the structure and operation of this ski binding is explicitly described in said U.S. Pat. No. 3,921,995, the description of such structure will be abbreviated here, it being understood that reference may be had to said patent to amplify or further explain the present description.

The ski binding, generally indicated at 11, broadly includes resiliently-loaded holding means operatively interposed between the sole-plate 12 of a boot assembly (not fully shown) and a ski 13 for releasably holding the boot assembly to the ski and for permitting the boot assembly to separate from the ski in any direction away from the ski.

As used herein, the term "boot assembly" is primarily intended to identify the combination of the sole-plate 12 and the skier's boot (not shown). These elements are normally coupled together by means of a toe cable 14 and a heel cable 15. However, it should be clearly understood that the term "boot assembly" is not intended to be limited to this precise combination, and should be construed in its broadest sense to include operative structure other than that specifically shown and described. For example, it is contemplated that a ski boot itself could be provided with the various surfaces and parts of the sole-plate, thereby omitting the need for a separate sole-plate. Such a contemplated boot construction is intended to be within the scope of the expression, "boot assembly" as used herein.

The resiliently-loaded holding means of the ski binding broadly provides at each of three mutually-spaced locations arranged at the apices of an imaginary isosceles triangle, areas or points of contact between the boot assembly and ski. In FIG. 1, the first of these locations is arranged at the point of contact between the leftward first convex ball stud 16 and a first concave cam surface 18 of the improved pivot clip 10; the second of these locations is arranged at the point of contact between the rightward second convex ball stud 19 and a second concave cam surface 20 of the improved pivot clip 10; and the third of these locations is arranged rearwardly of the first two at the point of contact between the convex nose 21 of a forwardly-biased plunger 22 of plunger assembly 23 and the rearwardly-facing concave release cam 24 on the sole-plate. Hence, these three locations are arranged at the apices of an imaginary isosceles triangle, with the rearward third location being generally coincident with the longitudinal axis 25 of the ski, and with the forward first and second locations being transversely separated from one another on opposite sides of such centerline.

The improved pivot clip 10 allows the use of stiffer springs in the plunger assembly to increase the ability of the binding to resist lateral shock loads, without simultaneously increasing the torque required to cause the boot assembly to separate from the ski.

Figure 2:
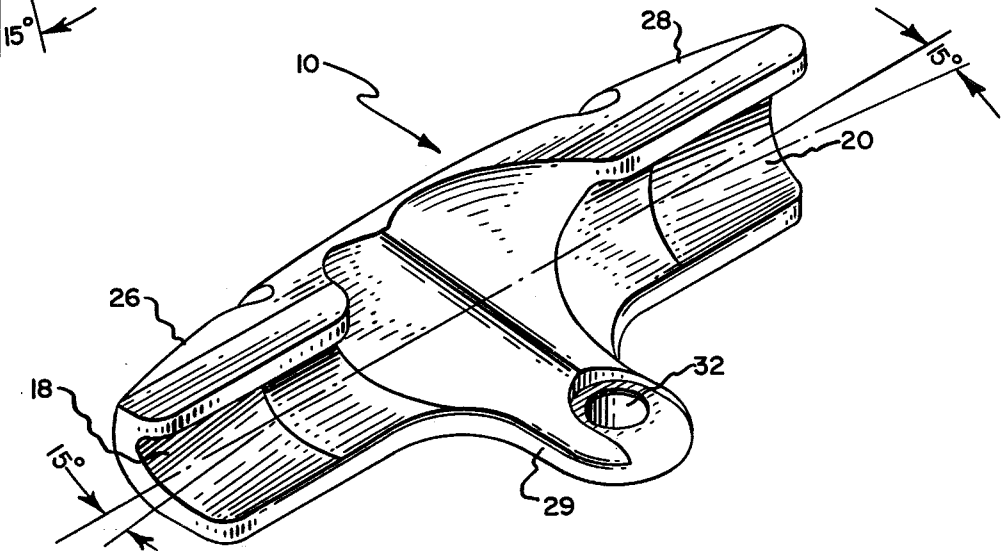
FIG. 2 is a left rear perspective detail view of the improved pivot clip.
Figure 3:
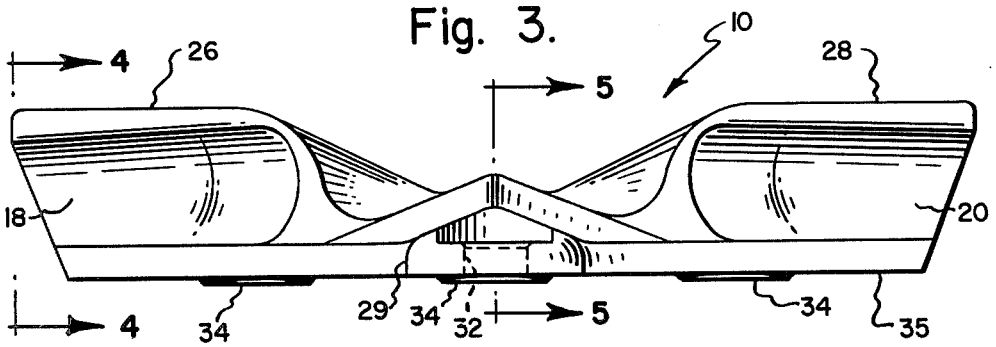
FIG. 3 is a rear elevation of the pivot clip shown in FIG. 2.
Figure 4:
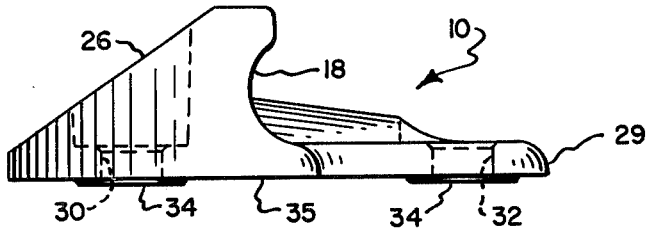
FIG. 4 is a left side elevation of the improved pivot clip.
Figure 5:
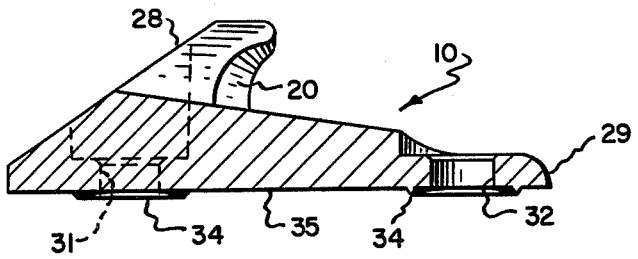
FIG. 5 is a longitudinal vertical sectional view thereof, taken generally on line 5—5 of FIG. 3.

Referring now to FIGS. 2–5, the pivot clip 10 is shown as being an integrally-formed uniquely configured structural member which has a somewhat T-shaped appearance when viewed in top plan. Thus, this pivot clip 10 has a leftwardly-extending wing portion 26, a rightwardly-extending wing portion 28, and a rearwardly-extending leg portion 29. As best shown in FIGS. 2, 4 and 5, the two wing and leg portions 26, 28 and 29 are severally provided with vertical through holes 30, 31 and 32, respectively, to accommodate passage of suitable fasteners, such as those severally indicated at 33 in FIG. 1, by which pivot clip may be mounted on the upper surface of the ski. Moreover, an annular pointed rib, severally indicated at 34, extends downwardly from the lower planar surface 35 of the clip about each of openings 30–32. When the pivot clip 10 is mounted on the ski, these sharpened annular ribs 34 will penetrate the ski to further inhibit relative movement between the pivot clip and ski.

The left and right cam surfaces 18, 20 are shown as being horizontally-elongated concave surfaces which extend rearwardly and laterally outwardly toward the left and right sides of the ski, respectively. From a comparison of FIGS. 2, 4 and 5, it will be noted that the extent of the overhand or lip above the cam surfaces 18, 20 progressively decreases as one proceeds outwardly along such surfaces toward the associated side of the ski. This is because the longitudinal axis of each cam surface is inclined outwardly and rearwardly at an acute included angle of about fifteen degrees in a horizontal plant with respect to a line perpendicular to the vertical plane including the longitudinal centerline of the ski, as shown in FIGS. 1 and 2.

Figure 6:
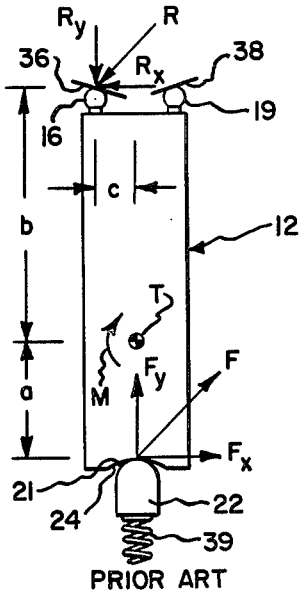
FIG. 6 is a schematic view of a known binding, as taught by U.S. Pat. No. 3,921,995, and illustrating the reactive forces opposing an applied moment.
Figure 7:
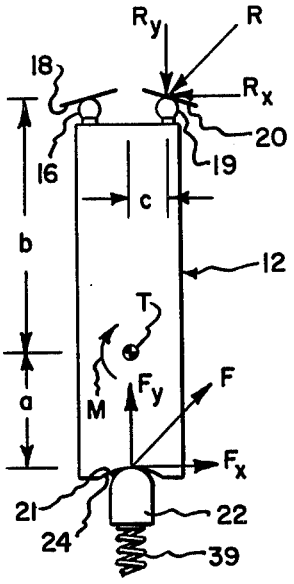
PRIOR ART Fig. 7.
FIG. 7 is a schematic view of the improved binding incorporating the inventive pivot clip, and also illustrating the reactive forces opposing an applied moment.

The operation and advantages of the improved pivot clip may be best understood by a comparison of FIGS. 6 and 7.

FIG. 6 is a schematic view of a prior art binding, such as taught by U.S. Pat. No. 3,921,995. In this earlier form of binding, the cam surfaces 36, 38 extended outwardly and forwardly at an acute included angle of about fifteen degrees (see FIG. 7 of U.S. Pat. No. 3,921,995). An external moment M applied to the sole-plate 12 about the tibial axis of the skier's leg would cause the binding to "exercise" or move slightly relative to the ski, and would cause one of the ball studs 16, 19 to separate from its associated cam surface. If equilibrium was reached in this condition, the applied moment M would be resisted by a rearward force F, acting normal to the point of contact between the plunger nose 21 and release cam 24, and by a forward force R, again acting perpendicular to the point of contact between one of the ball studs, such as stud 16 in FIG. 6, and its engaged cam surface 36. Rearward force F may be regarded as having a longitudinal component $F_y$, and a transverse component $F_x$. Similarly, forward force R may be regarded as having a longitudinal component $R_y$, and a transverse component $R_x$.

In equilibrium, the applied moment M about the tibial axis T would be resisted by component $F_x$, acting at an arm distance "a"; by component $R_x$, acting at an arm distance "b"; and by component $R_y$, acting at an arm distance "c". Component $F_y$ would not produce a counter-moment about the tibial axis because such force does not act at an arm distance therefrom. Hence, in equilibrium, $$M=F_x(a)+R_x(b)+R_y(c)$$

The point here is that, in this known binding, one of the forward cam surfaces, such as 36, would exert a reactive force R on its associated ball stud 16, and this reactive force would have a longitudinal component $R_y$ which would act at a certain arm distance ("c") from the tibial axis T to produce a counter-moment opposing the applied moment M. Since the magnitude of forces F and R is determined by the stiffness of plunger spring 39, the additive effect of the "$R_y(c)$" counter-moment required that the spring-rate of plunger spring 39 be unnecessarily low to permit torsional separation of the boot assembly from the ski at a desired level of release torque.

FIG. 7 is a schematic view of the improved ski binding incorporating the inventive pivot clip. The structure of the binding depicted in FIG. 7 is identical to that shown in FIG. 6, except that the pivot clip cam surfaces 18 and 20 are shown as being rearwardly and outwardly inclined, as opposed to forwardly and outwardly inclined in FIG. 6. The angles of inclination of the several cam surfaces in FIGS. 6 and 7 are about fifteen degrees.

If an external moment M is applied to the sole-plate 12 in FIG. 7 about the tibial axis, this moment will be opposed in equilibrium by a rearward force F, as previously described, and by a forward reactive force R acting between cam surface 20 and ball stud 19. However, it should be noted that whereas reactive force R was exerted on the leftward ball stud 16 in FIG. 6, in the improved binding this reactive force will be exerted on the rightward ball stud 19. Again, the longitudinal component $F_y$ will not produce a counter-moment about the tibial axis. In equilibrium, a moment balance about the tibial axis T reveals that the applied moment M will be opposed by transverse component $F_x$, acting at an arm distance "a"; and by a transverse component $R_x$ acting at an arm distance "b". However, the longitudinal component $R_y$ will produce a counter-moment acting in the same direction as the applied moment, both of these being clockwise in FIG. 7. Hence, in equilibrium, $$M=F_x(a)+R_x(b)-R_y(c)$$

Hence, in the improved design, the reactive longitudinal component is subtractive rather than additive. The advantage of this is that in the improved binding, the spring rate of plunger spring 39 can be increased substantially to increase the binding's shock adsorption capability to resist lateral loads, while maintaining release torque at the desired level.

This is demonstrated by comparing the old and new bindings in terms of their lateral ratios, which is defined to be the ratio of the lateral release load applied to the sole-plate at the tibial axis, to the release torque per unit of boot length. In other words, the lateral ratio is proportional to the lateral force required to release divided by the desired release torque. It has been found that whereas the binding depicted in FIG. 6 has a lateral ratio of about 1.34, the spring rate of the plunger spring 39 in the improved binding may be increased to provide a lateral ratio of about 3.25 for an equivalent release torque setting.

While the improved pivot clip is particularly adapted for use in the type of binding disclosed in said U.S. Pat. No. 3,921,995, such improvement may be used in association with other types of bindings as well. Also, the sole-plate need not invariably be suspended above the ski. Indeed, such sole-plate may rest on the ski or some other structure, as desired.

The positions of the various convex and concave members may be reversed. Hence the plunger may be located at the front of the binding, if need be. Also, the convex members may be alternatively mounted on ski with the associated cam surfaces mounted on the sole-plate, or the boot assembly. The fifteen degree angle of inclination of the cam surfaces is not deemed to be critical and may be readily varied.

Therefore, while the presently preferred embodiment of the improved pivot clip has been illustrated and described, and several modifications thereof discussed, persons skilled in this art will readily appreciate that various additional changes and modifications may be made without departing from the spirit of the invention, as defined by the following claims.

What is claimed is:

1. In a ski binding having resiliently-loaded holding means operatively interposed between a boot assembly and a ski for releasably holding said boot assembly to said ski and for permitting said boot assembly to separate from said ski in any direction away from said ski, said holding means including at each of three mutually-spaced locations arranged at the apices of an imaginary triangle a concave surface on one of said boot assembly and ski and a convex surface on the other of said boot assembly and ski and contacting said concave surface, the improvement which comprises: a pivot clip mounted fast to one of said ski and boot assembly, said pivot clip including a first cam surface providing a first of said concave surfaces at a first of said locations arranged on one side of the longitudinal axis of said ski;

a second cam surface providing a second of said concave surfaces at a second of said locations spaced transversely from said first location and arranged on the other side of said longitudinal axis;

each of said first and second cam surfaces being so inclined such that an external moment applied to said boot assembly about the tibial axis of the skier's leg will produce a reaction force between one of said cam surfaces and its associated convex member, and wherein the longitudinal component of said reaction force will not oppose said applied moment.

2. The improvement as set forth in claim 1 wherein said longitudinal component will produce a torque about said tibial axis in the same direction as said applied moment.

3. The improvement as set forth in claim 1 wherein said pivot clip is mounted on said ski.

* * * * *